US010902788B2

(12) United States Patent
Zhao et al.

(10) Patent No.: US 10,902,788 B2
(45) Date of Patent: Jan. 26, 2021

(54) SCAN DRIVERS, DRIVING METHODS THEREOF AND ORGANIC LIGHT EMITTING DISPLAYS

(71) Applicant: KunShan Go-Visionox Opto-Electronics Co., Ltd., Kunshan (CN)

(72) Inventors: Guohua Zhao, Kunshan (CN); Siming Hu, Kunshan (CN); Lu Zhang, Kunshan (CN); Zhenzhen Han, Kunshan (CN); Hui Zhu, Kunshan (CN)

(73) Assignee: KunShan Go-Visionox Opto-Electronics Co., Ltd., Kunshan (CN)

( * ) Notice: Subject to any disclaimer, the term of this patent is extended or adjusted under 35 U.S.C. 154(b) by 32 days.

(21) Appl. No.: 16/427,728

(22) Filed: May 31, 2019

(65) Prior Publication Data

US 2019/0287465 A1 Sep. 19, 2019

Related U.S. Application Data

(63) Continuation of application No. PCT/CN2018/107279, filed on Sep. 25, 2018.

(30) Foreign Application Priority Data

Jan. 19, 2018 (CN) ..... 2018 1 0055578

(51) Int. Cl.

| | |
|---|---|
| ***G09G 3/3275*** | (2016.01) |
| ***G09G 3/3266*** | (2016.01) |
| ***G09G 3/3225*** | (2016.01) |

(52) U.S. Cl.
CPC ..... *G09G 3/3266* (2013.01); *G09G 3/3225* (2013.01); *G09G 3/3275* (2013.01); *G09G 2310/0283* (2013.01); *G09G 2310/08* (2013.01)

(58) Field of Classification Search
CPC .. G09G 3/3266; G09G 3/3225; G09G 3/3275; G09G 2310/0283; G09G 2310/08;
(Continued)

(56) References Cited

U.S. PATENT DOCUMENTS

2012/0050234 A1* 3/2012 Jang ..... G09G 3/3225 345/204
2012/0327131 A1 12/2012 Jang
(Continued)

FOREIGN PATENT DOCUMENTS

CN 1674074 A 9/2005
CN 102855858 A 1/2013
(Continued)

OTHER PUBLICATIONS

PCT Written opinion dated Dec. 28, 2018 in International Application No. PCT/CN2018/107279.
(Continued)

*Primary Examiner* — Amit Chatly
(74) *Attorney, Agent, or Firm* — Rimon PC

(57) ABSTRACT

The present application provides a scan driver, a driving method thereof and an organic light emitting display. The scan driver includes a first driving area and a second driving area. The first driving area includes a number of first driving units, and the number of the first driving units sequentially sends a first driving signal and a third driving signal to a scan line. The second driving area includes a number of second driving units, and the number of the second driving units sequentially sends a second driving signal to the scan line.

10 Claims, 5 Drawing Sheets

(58) Field of Classification Search
CPC ... G09G 2310/0262; G09G 2310/0205; G09G 2310/0286
See application file for complete search history.

(56) References Cited

U.S. PATENT DOCUMENTS

| | | | | |
|---|---|---|---|---|
| 2014/0055444 | A1* | 2/2014 | Jang | G09G 3/3291 345/213 |
| 2018/0190179 | A1 | 7/2018 | Zhao | |
| 2018/0211717 | A1* | 7/2018 | Feng | G11C 19/28 |

FOREIGN PATENT DOCUMENTS

| | | | |
|---|---|---|---|
| CN | 104240643 | A | 12/2014 |
| CN | 104425034 | A | 3/2015 |
| CN | 105047120 | A | 11/2015 |
| CN | 106297636 | A1 | 1/2017 |
| CN | 106875917 | A | 6/2017 |
| CN | 106991955 | A | 7/2017 |
| CN | 107978277 | A | 5/2018 |
| TW | 201232518 | A | 8/2012 |
| TW | 201409458 | A | 3/2014 |
| TW | 201523571 | A | 6/2015 |
| TW | 201525969 | A | 7/2015 |

OTHER PUBLICATIONS

Taiwan First Office Action for Application No. 107135050 dated Aug. 28, 2019.
European search report for Application No. 18901607.4 dated Apr. 8, 2020.
Chinese Patent Office, First Office Action for CN Application No. 201810055578.5 dated Sep. 19, 2018.
PCT International Search Report dated Dec. 28, 2018 in International Application No. PCT/CN2018/107279.

* cited by examiner

SCAN DRIVERS, DRIVING METHODS THEREOF AND ORGANIC LIGHT EMITTING DISPLAYS

CROSS-REFERENCE TO RELATED APPLICATIONS

This application is a continuation of International Application No. PCT/CN2018/107279 filed on Sep. 25, 2018, which claims priority to Chinese patent application No. 201810055578.5 filed on Jan. 19, 2018. Both applications are incorporated herein by reference in their entireties.

TECHNICAL FIELD

The present application relates to the field of display technologies.

BACKGROUND

With the development of the market of mobile terminals, mobile terminal manufacturers have different requirements for the scanning direction of the Active Matrix Organic Light Emitting Diode (AMOLED), and the development of a scanning circuit supporting forward and reverse scans meets market demands.

SUMMARY

Purposes of the present application are to provide scan drivers, driving methods thereof and organic light emitting displays in order to realize bidirectional scanning of scan drivers of AMOLED screens.

In order to solve foregoing technical problems, an exemplary embodiment of the present application provides a scan driver. The scan driver sequentially provides a scan signal to a scan line. The scan signal is provided to a plurality of pixels by the scan line. The scan driver includes: a first driving area and a second driving area. The first driving area includes a plurality of first driving units. Each of the plurality of the first driving units includes an input end and an output end. The plurality of the first driving units sequentially sends a first driving signal and a third driving signal to the scan line. The plurality of the first driving units is arranged in a row. The input end of a former first driving unit is connected to the output end of a latter first driving unit adjacent to the former first driving unit through a first transistor. The output end of the former first driving unit is connected to the input end of the latter first driving unit adjacent to the former first driving unit through a second transistor. The second driving area includes a plurality of second driving units. Each of the plurality of the second driving units includes an input end and an output end. The plurality of the second driving units sequentially sends a second driving signal to the scan line. The plurality of the second driving units is arranged in a row. The input end of a former second driving unit is connected to the output end of a latter second driving unit adjacent to the former second driving unit through a third transistor. The output end of the former second driving unit is connected to the input end of the latter second driving unit through a fourth transistor.

Optionally, in the first driving area of the scan driver, the input end of the first driving unit at the head of the row of the plurality of first driving units is further connected to a first starting signal through a fifth transistor. The input end of the first driving unit at the end of the row of the plurality of first driving units is further connected to the first starting signal through a sixth transistor.

Optionally, in the second driving area of the scan driver, the input end of the second driving unit at the head of the row of the plurality of second driving units is further connected to a second starting signal through a seventh transistor. The input end of the second driving unit at the end of the row of the plurality of second driving units is further connected to the second starting signal through an eighth transistor.

Optionally, in the scan driver, gates of the first transistor, the third transistor, the sixth transistor and the eighth transistor are connected to a first direction enable signal. Gates of the second transistor, the fourth transistor, the fifth transistor and the seventh transistor are connected to a second direction enable signal.

Optionally, the first transistor, the second transistor, the third transistor, the fourth transistor, the fifth transistor, the sixth transistor, the seventh transistor and the eighth transistor all are P-type thin membrane transistors.

Optionally, in the scan driver, phases of the first direction enable signal and the second direction enable signal are non-overlapping.

Optionally, in the scan driver, each of the plurality of pixels includes a first driving end, a second driving end and a third driving end. The first driving signal is provided to the first driving end. The second driving signal is provided to the second driving end. The third driving signal is provided to the third driving end.

Optionally, in the scan driver, the plurality of pixels is arranged in a row. The output end of a nth first driving unit is connected to the first driving end of a nth pixel. The output end of a nth second driving unit is connected to the second driving end of the nth pixel. The output end of a (n+1)th first driving unit is connected to the third driving end of a nth pixel. Wherein n is a natural number.

Optionally, in the scan driver, each of the plurality of first driving units comprises a first clock signal end and a second clock signal end. The first clock signal end of an odd first driving unit and the second clock signal end of an even first driving unit are connected to a first clock signal. The second clock signal end of the odd first driving unit and the first clock signal end of the even first driving unit are connected to a second clock signal. The second driving unit comprises a first clock signal end and a second clock signal end. The first clock signal end of an odd second driving unit and the second clock signal end of an even second driving unit are connected to a third clock signal. The second clock signal end of the odd second driving unit and the first clock signal end of the even second driving unit are connected to a fourth clock signal.

The present application further provides a driving method of the scan driver as described above. The driving method includes: when a forward scan is performed, maintaining the first direction enable signal at a first level, and maintaining the second direction enable signal at a second level; providing the first starting signal to the input end of the first driving unit at the head, after a unit time period, providing the second starting signal to the input end of the second driving unit at the head; and when a reverse scan is performed, maintaining the first direction enable signal at the second level, and maintaining the second direction enable signal at the first level; providing the first starting signal to the input end of the first driving unit at the end, after two unit time periods, providing the second starting signal to the input end of the second driving unit at the end; wherein the first level is higher than the second level.

The present application further provides an organic light emitting display, the organic light emitting display includes: the scan driver as described above; a data driver providing a data signal to a data line; an emission control driver providing an emission control signal to an emission control line; and pixels placed at an intersection region of the scan line, the data line and the emission control line.

In the scan driver, the driving method thereof and the organic light emitting display provided by the present application. The input end of the former first driving unit is connected to the output end of the latter first driving unit adjacent to the former first driving unit through a first transistor. The output end of the former first driving unit is connected to the input end of the latter first driving unit adjacent to the former first driving unit through a second transistor. By controlling the first transistor and the second transistor to be turned on under different conditions, the output end of the former first driving unit can be connected to the input end of the latter first driving unit adjacent to the former first driving unit (that is, the output end of the former first driving unit provides a trigger signal for the latter first driving unit adjacent to the former first driving unit), or the output end of the latter first driving unit can be connected to the input end of the former first driving unit adjacent to the latter first driving unit (that is, the input end of the former first driving unit receives the trigger signal from the latter first driving unit adjacent to the former first driving unit). A forward conduction is performed by providing the trigger signal for the latter first driving unit. A reverse conduction is performed by receiving the trigger signal from the latter first driving unit. Similarly, the input end of a former second driving unit is connected to the output end of a latter second driving unit adjacent to the former second driving unit through a third transistor. The output end of the former second driving unit is connected to the input end of the latter second driving unit adjacent to the former second driving unit through a fourth transistor. By controlling the third transistor and the fourth transistor to be turned on under different conditions, the output end of the former second driving unit can be connected to the input end of the latter second driving unit adjacent to the former second driving unit (that is, the output end of the former second driving unit provides the trigger signal for the latter second driving unit adjacent to the former second driving unit), or the output end of the latter second driving unit can be connected to the input end of the former second driving unit adjacent to the latter second driving unit (that is, the input end of the former second driving unit receives the trigger signal from the latter second driving unit adjacent to the former second driving unit). A forward conduction is performed by providing the trigger signal for the latter first driving unit, and a reverse conduction is performed by receiving the trigger signal from the latter first driving unit.

Figure 1:
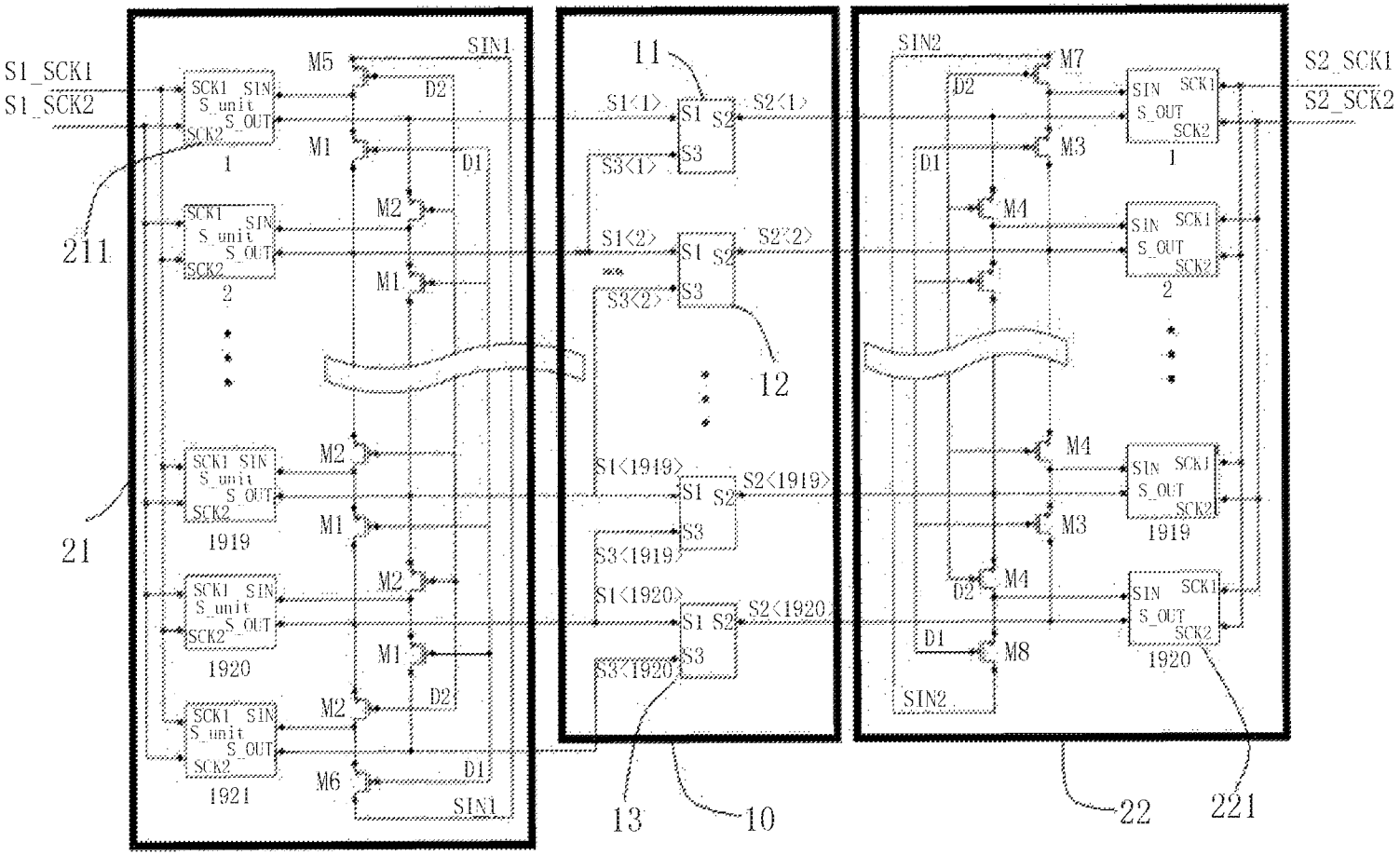
FIG. 1 is a schematic diagram of an organic light emitting display according to an exemplary embodiment of the present application.

Explanation of symbols: 10—pixels; 11—first pixel; 12—second pixel; 13—last pixel; 21—first driving area; 211—first driving unit; 22—second driving area; 221—second driving unit.

DETAILED DESCRIPTION

In order to make purposes, technical means and advantages of the present application more clearly understood, the present invention will be further illustrated in detail below with reference to accompanying drawings.

At present, the liquid crystal display (LCD) can already perform forward and reverse bidirectional scanning, however the prior AMOLED screens can only perform single-direction scanning. In order to ensure that the AMOLED screens can also perform forward and reverse bidirectional scanning so as to improve competitiveness of the AMOLED screens, it is necessary to develop bidirectional scanning structures for the AMOLED screens.

Exemplary embodiments of the present application provide scan drivers, driving methods thereof and organic light emitting displays in order to realize bidirectional scanning of scan drivers of AMOLED screens.

In order to realize foregoing concepts, exemplary embodiments of the present application provide a scan driver, a driving method thereof and an organic light emitting display, the scan driver is configured to sequentially provide a scan signal to a scan line, and the scan signal is provided to a plurality of pixels by the scan line. The scan driver includes a first driving area and a second driving area. The first driving area includes a plurality of first driving units. Each of the plurality of the first driving units includes an input end and an output end. The plurality of the first driving units sequentially sends a first driving signal and a third driving signal to the scan line. The plurality of the first driving units is arranged in a row. The input end of a former first driving unit is connected to the output end of a latter first driving unit adjacent to the former first driving unit through a first transistor. The output end of the former first driving unit is connected to the input end of the latter first driving unit adjacent to the former first driving unit through a second transistor. The second driving area includes a plurality of second driving units. Each of the plurality of the second driving units includes an input end and an output end, and the plurality of the second driving units sequentially sends a second driving signal to the scan line. The plurality of the second driving units are arranged in a row, the input end of a former second driving unit is connected to the output end of a latter second driving unit adjacent to the former second driving unit through a third transistor. And the output end of the former second driving unit is connected to the input end of the latter second driving unit adjacent to the former second driving unit through a fourth transistor.

First Exemplary Embodiment

This exemplary embodiment provides a scan driver. The scan driver is configured to sequentially provide a scan signal to a scan line, the scan signal is provided to a plurality of pixels in a pixel unit 10 by the scan line. The scan driver includes a first driving area 21 and a second driving area 22. The first driving area 21 includes a plurality of first driving units 211. Each of the plurality of the first driving units 211 includes an input end SIN and an output end S_OUT, and the plurality of the first driving units 211 sequentially send a first driving signal S1<n> and a third driving signal S3<n> to the scan line, wherein n is a natural number; the plurality of the first driving units 211 are arranged in a row, the input end SIN of a former first driving units 211 is connected to the output end S_OUT of a latter first driving unit 211 adjacent to the former first driving unit 211 through a first transistor M1. The output end S_OUT of the former first driving unit 211 is connected to the input end SIN of the latter first driving unit 211 adjacent to the former first driving unit 211 through a second transistor M2. The second driving area 22 includes a plurality of second driving units 221. Each of the plurality of the second driving units includes an input end SIN and an output end S_OUT. The plurality of the second driving units 221 sequentially send a second driving signal S2<n> to the scan line The plurality of the second driving units 221 are arranged in a row, the input end SIN of a former second driving unit 221 is connected to the output end S_OUT of a latter second driving unit 221 adjacent to the former second driving unit 221 through a third transistor M3. The output end S_OUT of the former second driving unit 221 is connected to the input end SIN of the latter second driving unit 221 adjacent to the former second driving unit 221 through a fourth transistor M4. The internal circuit structures of the second driving unit 221 and the first driving unit 211 are the same.

Specifically, in the first driving area 21 of the scan driver, the input end SIN of the first driving unit 211 at the head is connected to a first starting signal SIN1 through a fifth transistor M5. The input end SIN of the first driving unit 211 at the end is connected to the first starting signal SIN1 through a sixth transistor M6. In the second driving area 22 of the scan driver, the input end SIN of the second driving unit 221 at the head is connected to a second starting signal SIN2 through a seventh transistor M7 The input end SIN of the second driving unit at the end is connected to the second starting signal SIN2 through an eighth transistor M8. The first driving unit 211 at the head refers to a first driving unit whose output end is connected to a first pixel 11, the second driving unit 221 at the head refers to a second driving unit whose output end is connected to the first pixel 11. The first driving unit 211 at the end refers to a first driving unit 211 whose output end is connected to a last pixel 13, and the second driving unit 221 at the end refers to a second driving unit 221 whose output end is connected to the last pixel 13.

Further, gates of the first transistor M1, the third transistor M3, the sixth transistor M6 and the eighth transistor M8 are connected to a first direction enable signal D1. Gates of the second transistors M2, the fourth transistors M4, a fifth transistor M5 and a seventh transistor M7 are connected to a second direction enable signal D2. The first transistor M1, the second transistor M2, the third transistor M3, the fourth transistor M4, the fifth transistor M5, the sixth transistor M6, the seventh transistor M7 and the eighth transistor M8 all are P-type thin membrane transistors. The phases of the first direction enable signal D1 and the second direction enable signal D2 are non-overlapping.

In addition, each pixel in the pixel unit 10 includes a first driving end S1, a second driving end S2 and a third driving end S3. The first driving signal S1<n> is provided to the first driving end S1. The second driving signal S2<n> is provided to the second driving end S2. The third driving signal S3<n> is provided to the third driving end S3. For example, in the first pixel 11, the first driving signal S1<1> is provided to the first driving end S1, the second driving signal S2<1> is provided to the second driving end S2, and the third driving signal S3<1> is provided to the third driving end S3. In a second pixel 12, the first driving signal S1<2> is provided to the first driving end S1, the second driving signal S2<2> is provided to the second driving end S2, and the third driving signal S3<2> is provided to the third driving end S3.

Further, the output end of the nth first driving unit 211 outputs the first driving signal S1<n> to the first driving end S1 of the nth pixel. The output end of the nth second driving unit 221 outputs the second driving signal S2<n> to the second driving end S2 of the nth pixel; the output end of the (n+1)th first driving unit 211 outputs the third driving signal S3<n> to the third driving end S3 of the nth pixel. Taking the first pixel 11 as an example, the output end S_OUT of a first driving unit 211 at the head of the row is connected to the first driving end S1 of the first pixel 11. The first driving signal S1<l> is provided thereto; the output end of a second driving unit 221 at the head of the row is connected to the second driving end S2 of the first pixel 11, and the second driving signal S2<1> is provided thereto; the output end of the second first driving unit of the row is connected to the third driving end S3 of the first pixel 11, and the third driving signal S3<1> is provided thereto.

Specifically, in the scan driver as shown in FIG. 1, each of the first driving units 211 includes a first clock signal end SCK1 and a second clock signal end SCK2. An outside first clock signal S1_SCK1 is input to the first clock signal end SCK1 of an odd first driving unit 211 and the second clock signal end SCK2 of an even first driving unit 211. An outside second clock signal S1_SCK2 is input to the second clock signal end SCK2 of the odd first driving unit 211 and the first clock signal end SCK1 of the even first driving unit 211. Each of the second driving units 221 also includes a first clock signal end SCK1 and a second clock signal end SCK2. An outside third clock signal S2_SCK1 is input to the first clock signal end SCK1 of the odd second driving unit 221 and the second clock signal end SCK2 of the even second driving unit 221. An outside fourth clock signal S2_SCK2 is input to the second clock signal end SCK2 of the odd second driving unit 221 and the first clock signal end SCK1 of the even second driving unit 221. The first clock signal S1_SCK1 input to the first driving unit 211 and the third clock signal S2_SCK1 input to the second driving unit 221 may be identical or different. The second clock signal S1_SCK2 input to the first driving unit 211 and the fourth clock signal S2_SCK2 input to the second driving unit 221 may be identical or different.

When a forward scan is performed, the first direction enable signal D1 is maintained at a first level, and the second direction enable signal D2 is maintained at a second level. A first starting signal SIN1 is provided to the input end of the first driving unit 211 at the head. After one unit time period, a second starting signal SIN2 is provided to the input end of the second driving unit 221 at the head. When a reverse scan is performed, the first direction enable signal D1 is maintained at the second level, the second direction enable signal D2 is maintained at the first level, the first starting signal SIN1 is provided to the input end of the first driving unit 211 at the end; after two unit time periods, the second starting signal SIN2 is provided to the input end of the second driving unit 221 at the end. The first level is higher than the second level.

This exemplary embodiment further provides an organic light emitting display. The organic light emitting display includes: the scan driver as described above; a data driver providing a data signal to a data line; an emission control line driver providing an emission control signal to an emission control line; and a plurality of pixels placed at an intersection region of the scan line, the data line and the emission control line.

According to the scan driver and the organic light emitting display provided by the exemplary embodiment, the input end SIN of a former first driving unit 211 is connected to the output end S_OUT of a latter first driving unit 211 through a first transistor M1, and the output end S_OUT of the former first driving unit 211 is connected to the input end SIN of the latter first driving unit 211 through a second transistor M2. By controlling the first transistor M1 and the second transistor M2 to be turned on under different conditions, the output end S_OUT of the former first driving unit 211 can be connected to the input end SIN of the latter first driving unit (that is, the output end S_OUT of the former first driving unit 211 provides a trigger signal for the latter first driving unit 211), or the output end S_OUT of the latter first driving unit 211 can be connected to the input end SIN of a former first driving unit 211 (that is, the former first driving unit 211 receives the trigger signal from the latter first driving unit 211). A forward conduction is performed by providing the trigger signal for the latter first driving unit. And a reverse conduction is performed by receiving the trigger signal from the latter first driving unit. Similarly, the input end SIN of a former second driving unit 221 is connected to the output end S_OUT of a latter second driving unit 221 through a third transistor M3. The output end S_OUT of the former second driving unit 221 is connected to the input end SIN of the latter second driving unit 221 through a fourth transistor M4. By controlling the third transistor M3 and the fourth transistor M4 to be turned on under different conditions, the output end S_OUT of the former second driving unit 221 can be connected to the input end SIN of the latter second driving unit 221 (that is, the output end S_OUT of the former second driving unit 221 provides the trigger signal for the latter second driving unit 221), or the output end S_OUT of the latter second driving unit 221 can be connected to the input end SIN of the former second driving unit 221 (that is, the former second driving unit 221 receives the trigger signal from the latter second driving unit 221). A forward conduction is performed by providing the trigger signal for the latter second driving unit 221, and a reverse conduction is performed by receiving the trigger signal from the latter second driving unit 221.

In summary, the above exemplary embodiments describe different configurations of a scan driver and an organic light emitting display in detail. Of course, the present application includes, but is not limited to, the configurations listed in the above exemplary embodiments, and any transformational contents in the basis of the configurations provided in the above exemplary embodiments are within the scope of protection of the present application. Those skilled in the art may perform drawing inferences according to contents of the above exemplary embodiments.

Second Exemplary Embodiment

The exemplary embodiments of the present application further provide a driving method of the scan driver as described above. As shown in FIG. 1 to FIG. 5, the first clock signal S1_SCK1 provided to the first driving unit 211 is ahead of the second clock signal S1_SCK2 provided to the first driving unit 211 and the third clock signal S2_SCK1 provided to the second driving unit 221 for one unit time period; the first clock signal S1_SCK1 provided to the first driving unit 211 is ahead of the fourth clock signal S2_SCK2 provided to the second driving unit 221 for two unit time periods. A clock signal takes two unit time periods as one cycle. Specifically, the first clock signal S1_SCK1 is provided to the first clock signal end SCK1 of one first driving unit 211 and the second clock signal end SCK2 of one second driving unit 221, the first falling edge of the first clock signal S1_SCK1 is temporarily not input to the second clock signal end SCK2 of the second driving unit 221 and is input to the second clock signal end SCK2 of the second driving unit 221 in the second falling edge. The second clock signal S1_SCK2 is provided to the second clock signal end SCK2 of the first driving unit 211 and the first clock signal end SCK1 of the second driving unit 221. The phases of the first clock signal S1_SCK1 and the second clock signal S1_SCK2 are non-overlapping.

When a forward scan is performed, a first direction enable signal D1 is maintained at a first level, a second direction enable signal D2 is maintained at a second level, and a first starting signal SIN1 is provided to the input end of a first driving unit 211 at the head. After one unit time period, a second starting signal SIN2 is provided to the input end of a second driving unit 221 at the head. When a reverse scan is performed, the first direction enable signal D1 is maintained at the second level, and the second direction enable signal D2 is maintained at the first level; the first starting signal SIN1 is provided to the input end of a first driving unit 211 at the end. After two unit time periods, the second starting signal SIN2 is provided to the input end of a second driving unit 221 at the end; and the first level is higher than the second level.

Figure 2:
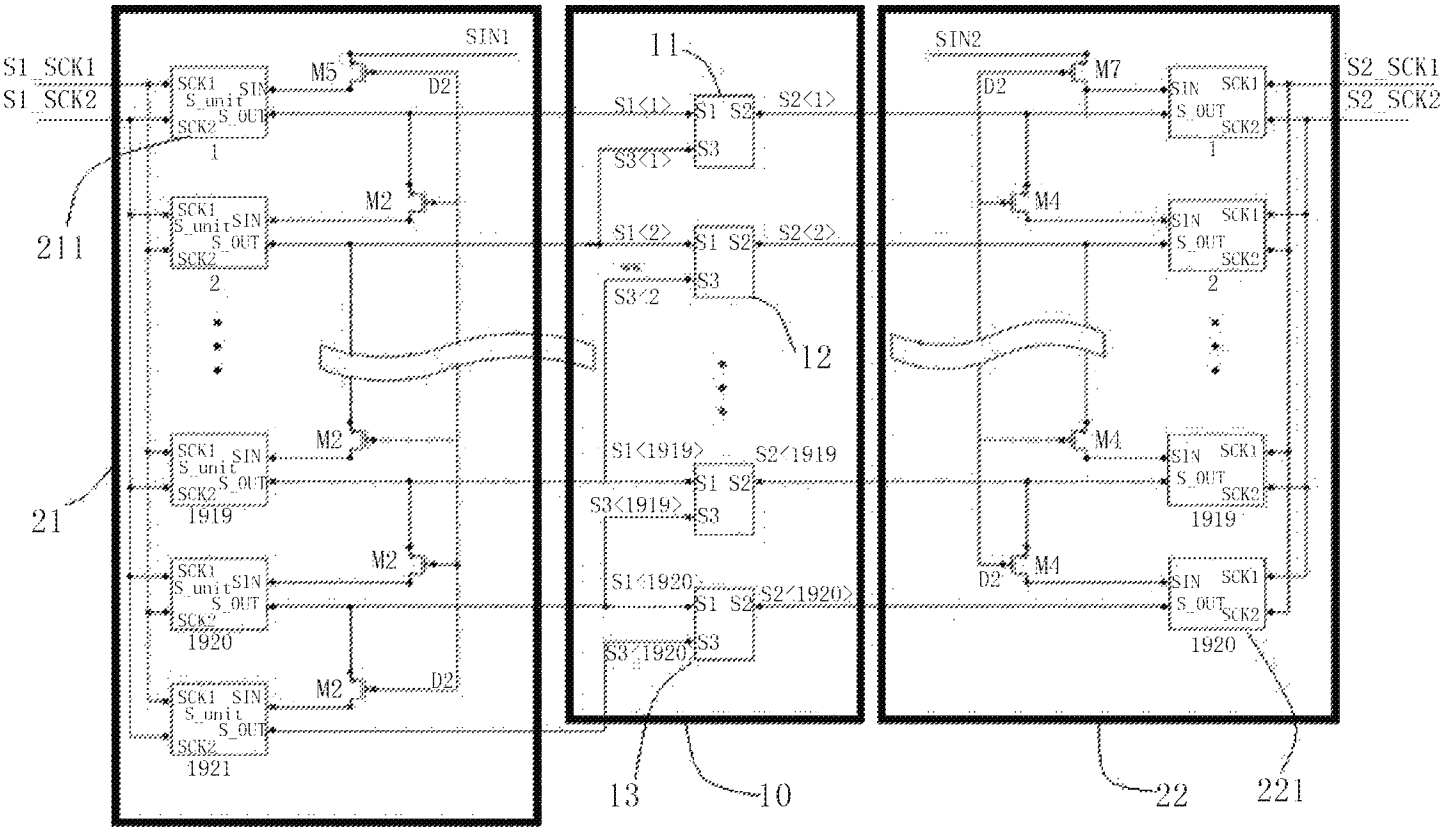
FIG. 2 is an equivalent circuit schematic diagram when an organic light emitting display is forward conduction according to an exemplary embodiment of the present application.
Figure 3:
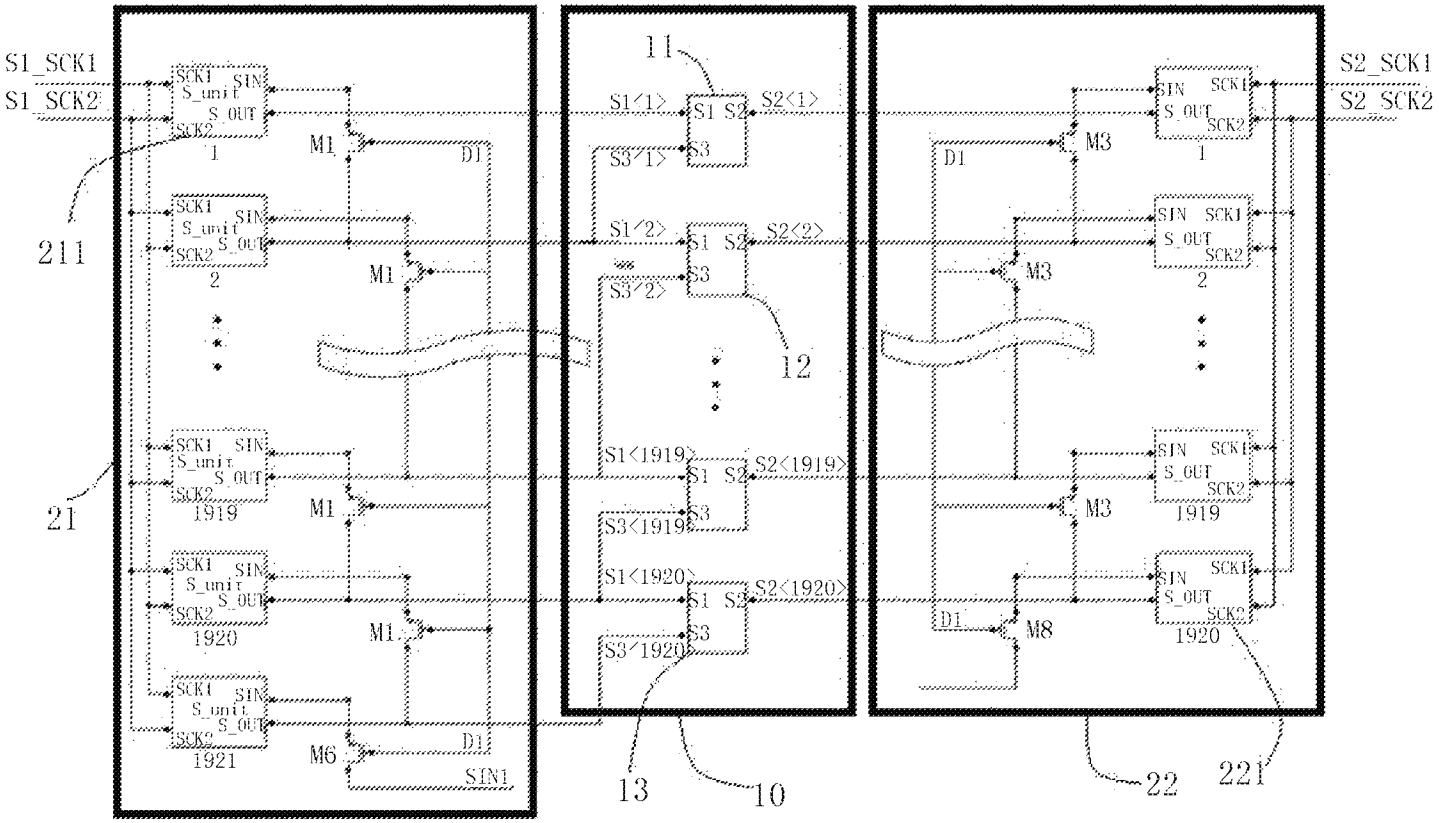
FIG. 3 is an equivalent circuit schematic diagram when an organic light emitting display is reverse conduction according to an exemplary embodiment of the present application.

Since the first direction enable signal D1 is provided to gates of first transistors M1, third transistors M3, a sixth transistor M6 and an eighth transistor M8; the second direction enable signal D2 is provided to gates of second transistors M2, fourth transistors M4, a fifth transistor M5 and a seventh transistor M7; and the first transistors M1, the second transistors M2, the third transistors M3, the fourth transistors M4, the fifth transistor M5, the sixth transistor M6, the seventh transistor M7 and the eighth transistor M8 all are P-type thin film transistors. When the forward scan is performed, the second transistors M2, the fourth transistors M4, the fifth transistor M5 and the seventh transistor M7 are turned on. The first transistors M1, the third transistors M3, the six-transistor M6 and the eighth transistor M8 are turned off, and an equivalent circuit is shown in FIG. 2. Specifically the output end S_OUT of a former first driving unit 211 is connected to the input end SIN of a latter first driving unit 211 adjacent to the former first driving unit 211. That is, the output end S_OUT of the former first driving unit 211 provides a trigger signal for the latter first driving unit 211, that is to say the forward conduction is performed. When the reverse scan is performed, the second transistors M2, the fourth transistors M4, the fifth transistor M5 and the seventh transistor M7 are turned off. The first transistors M1, the third transistors M3, the sixth transistor M6 and the eighth transistor M8 are turned on, and an equivalent circuit is shown in FIG. 3. Specifically the output end S_OUT of a latter first driving unit 211 is connected to the input end SIN of a former first driving unit 211. That is, the trigger signal input to the input end SIN of the former first driving unit 211 is received from the output end S_OUT of the latter first driving unit 211, that is to say the reverse conduction is performed.

In addition, when the forward scan is performed, in the first driving area 21, the fifth transistor M5 is turned on, and the first starting signal SIN1 is input to the input end of a first driving unit 211 at the head of the row of the plurality of first driving units through the fifth transistor M5, the first starting signal SIN1 is used as the trigger signal of the first driving unit 211 at the head of the row. The first driving signal S1<1> is output from the output end S_OUT of the first driving unit 211 at the head of the row and the first driving signal S1<1> is provided to the first pixel 11. The first driving signal S1<1> is also provided to the input end SIN of a second first driving unit 211 of the row through the second transistor M2, and the first driving signal S1<1> is used as the trigger signal of the second first driving unit 211 of the row. The second first driving unit 211 outputs a third driving signal S3<1>, the third driving signal S3<1> is provided for the first pixel 11. The third driving signal S3<1> is also provided for a second pixel 12 as the first driving signal S1<2>. That is, when the forward scan is performed, an output end S_OUT of a (n+1)th first driving unit outputs the third driving signal of an nth pixel, wherein n is a natural number. It can be seen that the first pixel 11 is scanned first, and the organic light emitting display is scanned forward.

Furthermore, in the second driving area 22, the seventh transistor M7 is turned on. The second starting signal SIN2 is input to the input end SIN of the first second driving unit 221 at the head of the row of the plurality of second driving units through the seventh transistor M7. The second driving signal SIN2 is used as the trigger signal of the first second driving unit 221 at the head of the row. The output end S_OUT of the first second driving unit 221 at the head of the row outputs the second driving signal S2<1>. The second driving signal S2<1> is provided for the first pixel 11. Since the second starting signal SIN2 lags behind the first starting signal SIN1 for one unit period, therefore, the second driving signal S2<1> lags behind the first driving signal S1<1> for one unit period. It can be seen that the first driving unit 211 or the second driving unit 221 can output a signal after signals are input for one unit time period. The second driving signal S2<1> output by the first second driving unit 221 at the head of the row is provided for the input end SIN of the second second driving unit 221 of the row through the fourth transistor M4, and the second driving signal S2<1> is used as the trigger signal of the second second driving unit 221. The second second driving unit 221 outputs the second driving signal S2<2> and provides the second driving signal S2<2> to the second pixel 12, the second driving signal S2<2> provided to the second pixel 12 lags behind the first driving signal S2<1> provided to the first pixel 11 for one unit time period. It can be seen that the first pixel 11 is scanned first. Then the second pixel 12 is scanned, and the organic light emitting display is scanned forward.

When the forward scan is performed, as for the three driving signals of one pixel, the first driving signal S1<n> is ahead of the second driving signal S2<n> and the third driving signal S3<n> for one unit time period. The second driving signal S2<n> is synchronized with the third driving signal S3<n>. A driving signal of a former pixel is ahead of a driving signal of a latter pixel for one unit time period.

Figure 5:
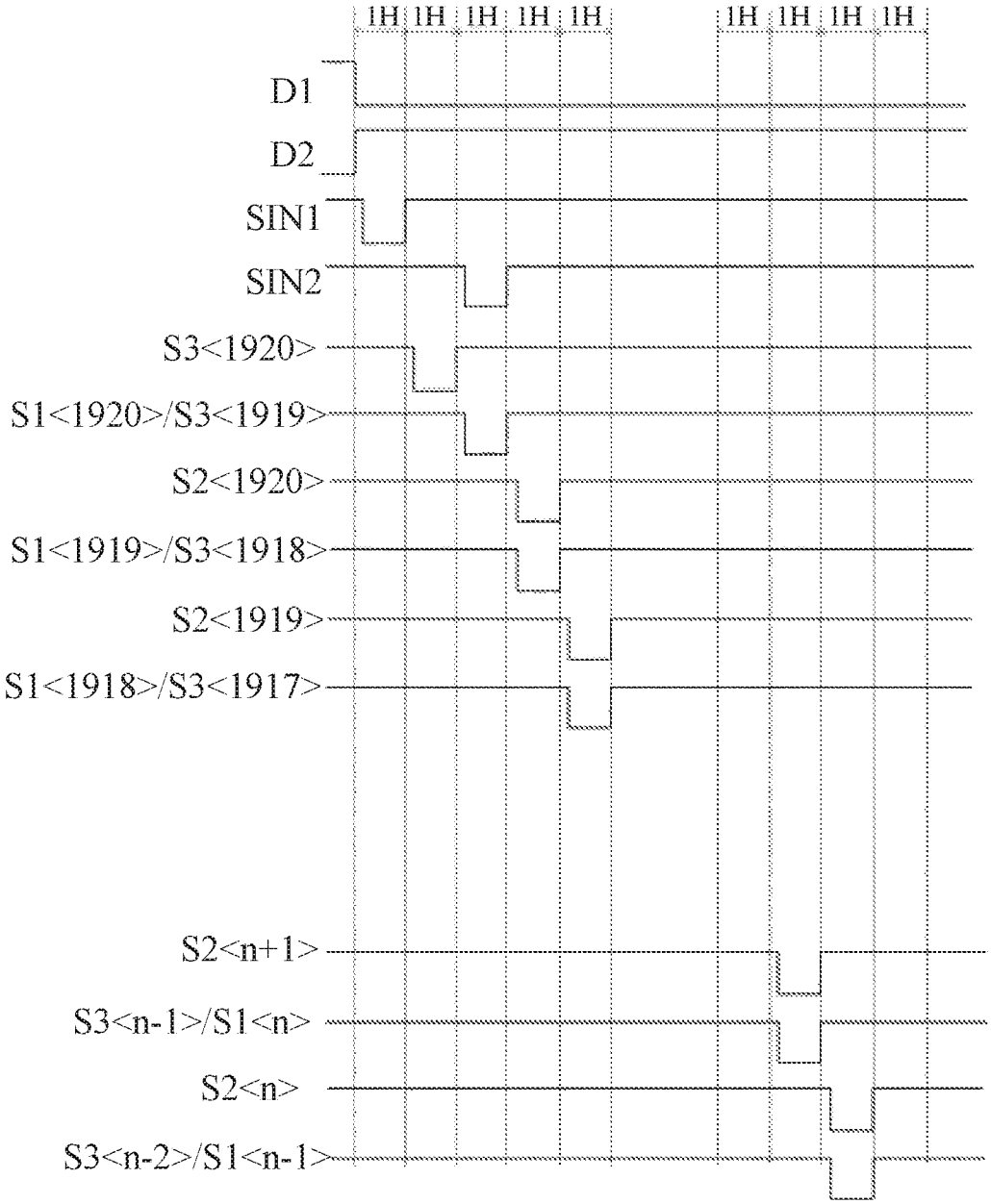

Similarly, when the reverse scan is performed, the sixth transistor M6 is turned on, and the first starting signal SIN1 is input to the input end SIN of the first driving unit 211 at the end through the sixth transistor M6 (the 1921th first driving unit of the row is illustrated in FIG. 3, the number of the first driving units in the row may be any natural number). The first starting signal SIN1 is used as the trigger signal of the last first driving unit 211 at the end of the row, and the output end S_OUT of the last first driving unit at the end of the row outputs the third driving signal S3<n> (S3<1920> exemplified in FIG. 3) of the last pixel 13 (the 1920th pixel of the row exemplified in FIG. 3), the third driving signal S3<n> is provided for the last pixel 13. Since the input signal of the first first driving unit 211 at the head of the row lags behind the output signal of the first first driving unit 211 at the head of the row for one unit time period, as shown in FIG. 5, the third driving signal S3<1920> lags behind the first starting signal SIN1 for one unit time period. The third driving signal S3<n> (S3<1920>) is provided for the input end SIN of the former first driving unit 211 through the first transistor M1 and used as a trigger signal of the former first driving unit, and the former first driving unit 211 outputs the first driving signal S1<n> (S1<1920> in FIG. 3). The first driving signal S1<n> is provided for the last pixel 13, and the first driving signal S1<1920> lags behind the third driving signal S3<1920> for one unit time period. At the same time, the first driving signal S1<1920> outputted is also provided for a penult pixel as the third driving signal S3<1919>. It can be seen that the output end S_OUT of the (n+1)th first driving unit outputs the third driving signal S3<n> of the nth pixel, wherein n is a natural number. It can be seen that the last pixel 13 is scanned first, and the organic light emitting display is scanned reversely.

Further, when the reverse scan is performed, the eighth transistor M8 is turned on. The second starting signal SIN2 is input to the input end SIN of the second driving unit 221 at the end (the 1920th second driving unit 221 of the row exemplified in FIG. 3, the number of the second driving units of the row may be any natural number) through the eighth transistor M8. The second starting signal SIN2 is used as the trigger signal of the last second driving unit 221 at the end of the row. The output end S_OUT of the second driving unit 221 at the end outputs the second driving signal S2<n> (S2<1920> in FIG. 3). The second driving signal S2<n> is provided for the last pixel 13 (the 1920th pixel of the row exemplified in FIG. 3). At the same time, the second driving signal S2<n> is provided for the input end SIN of a previous second driving unit 221 (S2<1919> in FIG. 3) through the third transistor M3. The second driving signal S2<n> is used as the trigger signal of the previous second driving unit 221. The previous second driving unit 221 at the row outputs the second driving signal S2<n>. The second driving signal S2<n> is provided for a previous pixel of the last pixel 13, that is, a pixel at a 1919th row. It can be seen that the last pixel 13 is scanned first, and the organic light emitting display is scanned reversely. Since the second starting signal SIN2 lags behind the first starting signal SIN1 for two unit time periods when the reverse scan is performed, the second driving signal S2<1920> lags behind the third driving signal S3<1920> for two unit time periods in a first clock cycle.

When the reverse scan is performed, as for the three driving signals of one pixel, the third driving signal S3<n> is ahead of the first driving signal S1<n> for one unit time period. The first driving signal S1<n> is ahead of the second driving signal S2<n> for one unit time period. The driving signal of a latter pixel is ahead of the corresponding driving signal of a former pixel for one unit time period.

Figure 4:
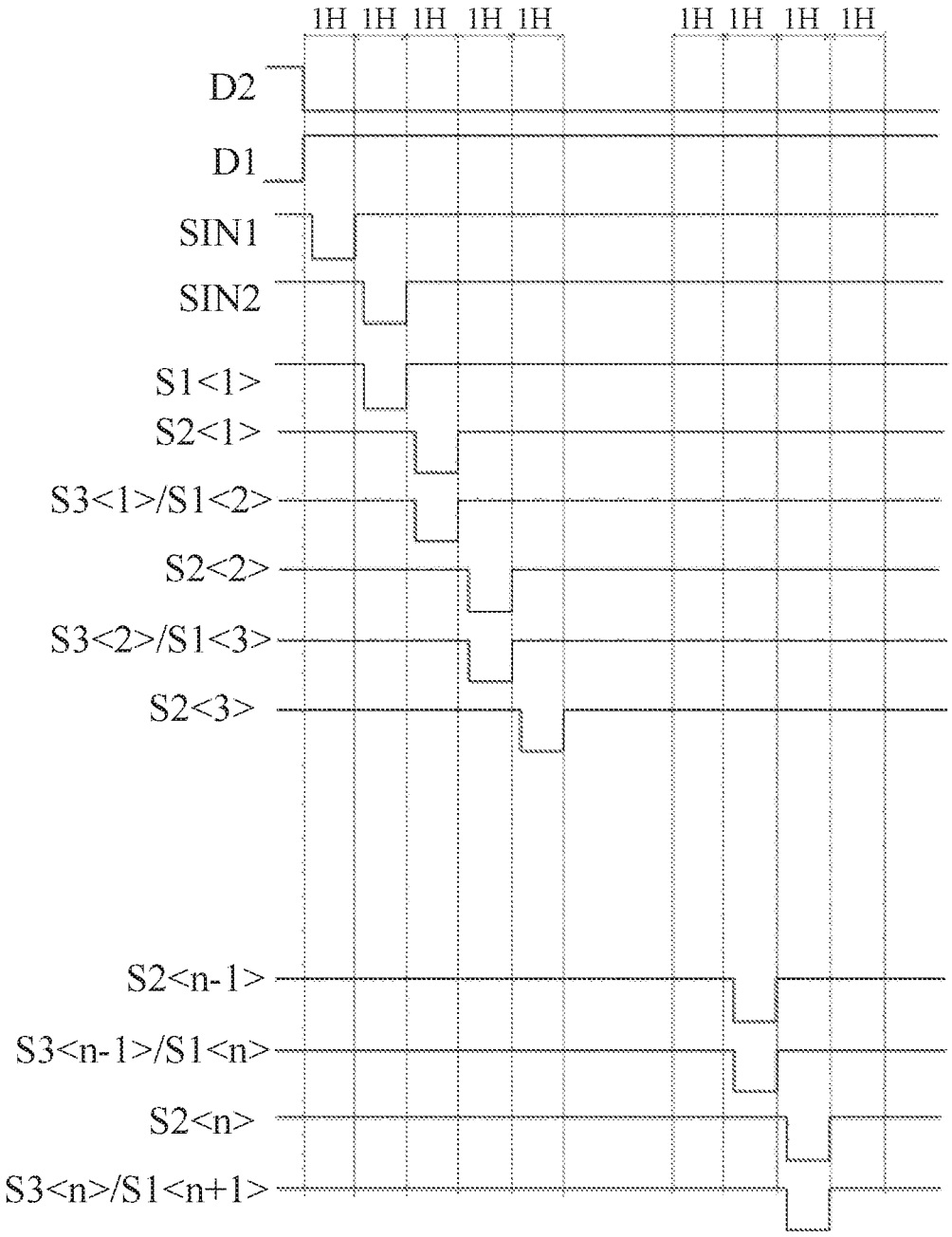
FIGS. 4-5 are schematic diagrams of scan driving methods of scan drivers of an exemplary embodiment of the present application.

As shown in FIG. 4-5, the first starting signal SIN1 and the second starting signal SIN2 are wide pulse signals. When the forward scan is performed, the first starting signal SIN1 is one unit time period H ahead of the second starting signal SIN2. When the reverse scan is performed, the first starting signal SIN1 is two unit time periods 2H ahead of the second starting signal SIN2. After the first starting signal SIN1 is input to the input end SIN of the first driving unit 211, the first driving unit 211 outputs the first driving signal S1<l>, the first driving signal S1<1> lags one unit time period H behind the first starting signal SIN1. Similarly, after the second starting signal SIN2 is input to the second driving unit 221, the second driving unit 221 outputs the second driving signal S2<1>, the second driving signal S2<1> lags one unit time period H behind the first starting signal SIN2. When the forward scan is performed, the second driving signal S2<1> lags one unit time period H behind the first driving signal S1<1>, therefore, after the first driving signal S1<1> used as the trigger signal is input to the input end SIN of the second pixel, the third driving signal S3<1> output by the output end S_OUT of the second pixel lags one unit time period H behind the first driving signal S1<1> and is synchronized with the second driving signal S2<1>, and so on. When the reverse scan is performed, the second driving signal S2<n> lags two unit time periods 2H behind the third driving signal S3<n>.

According to the driving method of scan drivers provided in this exemplary embodiment, the input end SIN of a former first driving unit 211 is connected to the output end S_OUT of a latter first driving unit 211 through a first transistor M1. The output end S_OUT of the former first driving units 211 is connected to the input end SIN of the latter first driving unit 211 through a second transistor M2. By controlling the first transistor M1 and the second transistor M2 to be turned on under different conditions, the output end S_OUT of the former first driving unit 211 can be connected to the input end SIN of the latter first driving unit 211 (that is, the output end S_OUT of the former first driving units 211 provides a trigger signal for the latter first driving unit 211), or the output end S_OUT of the latter first driving unit 211 can be connected to the input end SIN of the former first driving unit 211 (that is, the former first driving unit 211 receives a trigger signal from the latter first driving unit 211). A forward conduction is performed by providing the trigger signal for the latter driving unit 211, a reverse conduction is performed by receiving the trigger signal from the latter driving unit 211. Similarly, the input end SIN of a former second driving unit 221 is connected to the output end S_OUT of a latter second driving unit 221 through a third transistor M3, and the output end S_OUT of the former second driving unit 221 is connected to the input end SIN of a latter second driving unit 221 through a fourth transistor M4. By controlling the third transistor M3 and the fourth transistor M4 to be turned on under different conditions, the output end S_OUT of the former second driving unit 221 can be connected to the input end SIN of the latter second driving unit 221 (that is, the output end S_OUT of the former second driving unit 221 provides a trigger signal for the latter second driving unit 221), or the output end S_OUT of the latter second driving unit 221 can be connected to the input end SIN of the former second driving unit 221 (that is, the former second driving unit 221 received a trigger signal from the latter second driving unit 221). A forward conduction is performed by providing the trigger signal for the latter second driving unit 221, and a reverse conduction is performed by receiving the trigger signal from the latter second driving unit 221.

Various exemplary embodiments in this specification are described in a progressive manner, and each exemplary embodiment focuses on differences from other exemplary embodiments, and the same similar parts between the various exemplary embodiments may be referred to each other. For the system disclosed in the exemplary embodiments, due to corresponding to the method disclosed in the exemplary embodiments, the description is relatively simple, and the relevant parts may be referred to the description of the method part.

The above are only the preferred exemplary embodiments of the present application and are not intended to limit the scope of the present application. Any modifications, equivalent substitutions, improvements and the like within spirits and principles of the present application should be included in the scope of protection of the present application.

What is claimed is:

1. A scan driver, sequentially providing one or more scan signals to a scan line, the scan signals being provided to a plurality of pixels by the scan line, each of the plurality of pixels comprising a first driving end, a second driving end, and a third driving end, the scan driver comprising:

a first driving area, the first driving area comprising a plurality of first driving units, each of the plurality of the first driving units comprising an input end and an output end, the plurality of the first driving units sequentially sending a first scan signal and a third scan signal to the scan line; the plurality of the first driving units are arranged in a row, the input end of a former first driving unit being connected to the output end of a latter first driving unit adjacent to the former first driving unit through a first transistor; and the output end of the former first driving unit being connected to the input end of the latter first driving unit adjacent to the former first driving unit through a second transistor; and a second driving area, the second driving area comprising a plurality of second driving units, each of the plurality of the second driving units comprising an input end and an output end, the plurality of the second driving units sequentially sending a second scan signal to the scan line; the plurality of the second driving units being arranged in a row, the input end of a former second driving unit being connected to the output end of a latter second driving unit adjacent to the former second driving unit through a third transistor; and the output end of the former second driving unit being connected to the input end of the latter second driving unit adjacent to the former second driving unit through a fourth transistor;

wherein the first scan signal is provided to the first driving end, the second scan signal is provided to the second driving end, and the third scan signal is provided to the third driving end.

2. The scan driver of claim 1, wherein in the first driving area, the input end of the first driving unit at the head of the row of the plurality of first driving units is further connected to a first starting signal through a fifth transistor; and the input end of the first driving unit at the end of the row of the plurality of first driving units is further connected to the first starting signal through a sixth transistor.

3. The scan driver of claim 2, wherein in the second driving area, the input end of the second driving unit at the head of the row of the plurality of second driving units is further connected to a second starting signal through a seventh transistor; and the input end of the second driving unit at the end of the row of the plurality of second driving units is further connected to the second starting signal through a eighth transistor.

4. The scan driver of claim 3, wherein gates of the first transistor, the third transistor, the sixth transistor and the eighth transistor are connected to a first direction enable signal; and gates of the second transistor, the fourth transistor, the fifth transistor and the seventh transistor are connected to a second direction enable signal.

5. The scan driver of claim 4, wherein the first transistor, the second transistor, the third transistor, the fourth transistor, the fifth transistor, the sixth transistor, the seventh transistor and the eighth transistor all are P-type thin membrane transistors.

6. The scan driver of claim 4, wherein phases of the first direction enable signal and the second direction enable signal are non-overlapping.

7. The scan driver of claim 1, wherein the plurality of pixels are arranged in a row, the output end of a nth first driving unit is connected to the first driving end of a nth pixel; the output end of a nth second driving unit is connected to the second driving end of the nth pixel; and the output end of a (n+1)th first driving unit is connected to the third driving end of a nth pixel; wherein n is a natural number.

8. The scan driver of claim 4, wherein each of the plurality of first driving units comprises a first clock signal end and a second clock signal end; wherein the first clock signal end of an odd first driving unit and the second clock signal end of an even first driving unit are connected to a first clock signal;

the second clock signal end of the odd first driving unit and the first clock signal end of the even first driving unit are connected to a second clock signal; and the second driving unit comprises a first clock signal end and a second clock signal end; wherein the first clock signal end of an odd second driving unit and the second clock signal end of an even second driving unit are connected to a third clock signal; and the second clock signal end of the odd second driving unit and the first clock signal end of the even second driving unit are connected to a fourth clock signal.

9. A driving method of the scan driver of claim 8, when a forward scan is performed, the method comprising:

maintaining the first direction enable signal at a first level, and maintaining the second direction enable signal at a second level; and providing the first starting signal to the input end of the first driving unit at the head, after a unit time period, providing the second starting signal to the input end of the second driving unit at the head;

when a reverse scan is performed, the method comprising:

maintaining the first direction enable signal at the second level, and maintaining the second direction enable signal at the first level; and providing the first starting signal to the input end of the first driving unit at the end, after two unit time periods, providing the second starting signal to the input end of the second driving unit at the end;

the first level being higher than the second level.

10. An organic light emitting display, comprising:

the scan driver of claim 1;

a data driver providing a data signal to a data line;

an emission control driver providing an emission control signal to an emission control line; and pixels, placed at an intersection region of the scan line, the data line and the emission control line.

* * * * *